US009266134B2

(12) United States Patent
Wells

(10) Patent No.: US 9,266,134 B2
(45) Date of Patent: Feb. 23, 2016

(54) VENTED CHECK VALVES, PUMPS AND REFILL UNITS WITH VENTED CHECK VALVES

(71) Applicant: GOJO Industries, Inc., Akron, OH (US)

(72) Inventor: Jesse D. Wells, Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 207 days.

(21) Appl. No.: 13/792,113

(22) Filed: Mar. 10, 2013

(65) Prior Publication Data

US 2014/0158715 A1 Jun. 12, 2014

Related U.S. Application Data

(60) Provisional application No. 61/735,795, filed on Dec. 11, 2012.

(51) Int. Cl.

| | |
|---|---|
| ***F04B 7/00*** | (2006.01) |
| ***B05B 11/00*** | (2006.01) |
| *A47K 5/14* | (2006.01) |
| *B05B 7/00* | (2006.01) |
| *A47K 5/12* | (2006.01) |

(52) U.S. Cl.

CPC ..... *B05B 11/3001* (2013.01); *B05B 11/3063* (2013.01); *B05B 11/3069* (2013.01); *A47K 5/1207* (2013.01); *A47K 5/14* (2013.01); *B05B 7/0025* (2013.01); *B05B 11/0016* (2013.01); *B05B 11/3005* (2013.01)

(58) Field of Classification Search

CPC ..... F04B 7/0003; A47K 5/14

USPC ..... 222/190, 321.1, 321.7–321.9, 383.1, 222/383.3, 332, 442, 481.5, 188, 387, 372; 417/443

See application file for complete search history.

(56) References Cited

U.S. PATENT DOCUMENTS

| | | | | |
|---|---|---|---|---|
| 3,361,078 | A * | 1/1968 | Cooprider | 417/514 |
| 3,674,181 | A * | 7/1972 | Marks et al. | 222/179.5 |
| 4,646,945 | A | 3/1987 | Steiner | |
| 5,282,552 | A * | 2/1994 | Ophardt | 222/181.2 |
| 5,445,288 | A * | 8/1995 | Banks | 222/95 |
| 5,489,044 | A * | 2/1996 | Ophardt | 222/1 |

(Continued)

FOREIGN PATENT DOCUMENTS

FR 2199588 A1 4/1974

OTHER PUBLICATIONS

International Search Report from International Application No. PCT/US2013/073960, dated Mar. 18, 2014.

*Primary Examiner* — Donnell Long

(74) *Attorney, Agent, or Firm* — Calfee, Halter & Griswold LLP

(57) ABSTRACT

Vented check valves, pumps and refill units for dispensers are disclosed herein. Some embodiments disclose a refill unit including a container for holding a liquid. A pump chamber is secured to the container. The pump chamber is defined at least in part by a one-way liquid inlet check valve, a one-way liquid outlet check valve and at least one wall. The volume of the pump chamber is movable between a first volume and a second volume. The inlet check valve includes a venting recess. The venting recess allows air to flow past the inlet check valve in the opposite direction of the flow of liquid into the liquid chamber.

20 Claims, 2 Drawing Sheets

(56) References Cited

U.S. PATENT DOCUMENTS

| | | | | |
|---|---|---|---|---|
| 6,082,586 | A * | 7/2000 | Banks | 222/95 |
| 7,337,930 | B2 * | 3/2008 | Ophardt et al. | 222/628 |
| 8,733,588 | B2 * | 5/2014 | Ophardt et al. | 222/1 |
| 2002/0153389 | A1 * | 10/2002 | Creaghan et al. | 222/190 |
| 2005/0205600 | A1 * | 9/2005 | Ophardt et al. | 222/1 |
| 2007/0023454 | A1 * | 2/2007 | Ophardt | 222/190 |
| 2009/0001100 | A1 * | 1/2009 | van der Heijden | 222/190 |
| 2009/0188944 | A1 * | 7/2009 | Ciavarella et al. | 222/190 |
| 2011/0014076 | A1 * | 1/2011 | Shi et al. | 417/559 |
| 2011/0089198 | A1 * | 4/2011 | Leuliet | B05B 11/3004 222/321.9 |
| 2014/0061245 | A1 * | 3/2014 | McNulty et al. | 222/190 |

* cited by examiner

VENTED CHECK VALVES, PUMPS AND REFILL UNITS WITH VENTED CHECK VALVES

RELATED APPLICATIONS

This non-provisional utility patent application claims priority to and the benefits of U.S. Provisional Patent Application Ser. No. 61/735,795 filed on Dec. 11, 2012, and entitled VENTED CHECK VALVES, PUMPS AND REFILL UNITS WITH VENTED CHECK VALVES. This application is incorporated herein by reference in its entirety.

TECHNICAL FIELD

The present invention relates generally to check valves, pumps and refill units, and more particularly to vented check valves, pumps and refill units having vented check valves.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles by use of an air pump or air compressor. Most pumps, whether liquid pumps or foam pumps have a constant volume output and to change the volume requires one to change the pump or "short-stroke" the pump. A pump is short-stroked when the actuator of the dispenser is prevented from moving its full stroke. Problems often occur with pumps when they are short-stroked. If a blocking plate is added to the dispenser actuator so that the actuator does not drive the liquid piston the full length of the pump chambers, many pumps will not prime because an air bubble remains in the liquid piston. Another problem is that air trapped in the liquid dosing chamber results in an inconsistent output.

SUMMARY

Vented check valves, pumps and refill units for dispensers are disclosed herein. Some embodiments disclose a refill unit including a container for holding a liquid. A pump chamber is secured to the container. The pump chamber is defined at least in part by a one-way liquid inlet check valve, a one-way liquid outlet check valve and at least one wall. The volume of the pump chamber is movable between a first volume and a second volume. The inlet check valve includes a venting recess. The venting recess allows air to flow past the inlet check valve in the opposite direction of the flow of liquid into the liquid chamber.

In some embodiments, refill units include a container for holding a liquid and a pump secured to the container. The pump includes a pump chamber and an inlet check valve located upstream of the pump chamber. The inlet check valve includes an annular seal that has a venting recess located in the annular seal. Air in the pump chamber may pass through the venting recess in the annular seal and flow back up into the container that supplies liquid to the pump.

Exemplary embodiments of pumps include a pump chamber defined by a one-way liquid inlet check valve, a one-way liquid outlet check valve and at least one wall. The volume of the pump chamber is movable between a first volume and a second volume. The inlet check valve includes a venting recess. The venting recess allows air to flow past the inlet check valve in the opposite direction of the flow of liquid into the liquid chamber.

BRIEF DESCRIPTION OF THE DRAWINGS

These and other features and advantages of the present invention will become better understood with regard to the following description and accompanying drawings in which.

DETAILED DESCRIPTION

Exemplary embodiments of check valves, pumps and refill units disclosed herein alleviate problems of air in the liquid pump chamber that prevents a liquid pump from priming when the pump is short-stroked. The exemplary embodiments of vented check valves, liquid pumps, foam pumps and refill units having vented check valves shown and described herein may be used for many applications.

Figure 1A:
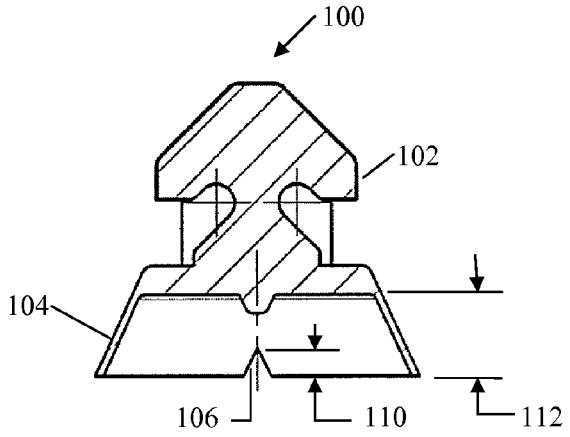
FIG. 1A illustrates an cross-section of an exemplary embodiment of a vented check valve.
Figure 1B:
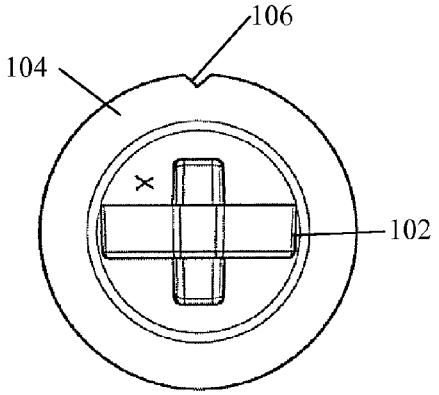
FIG. 1B illustrates a plan view of the exemplary embodiment of the vented check valve of FIG. 1A.

FIG. 1A illustrates an exemplary embodiment of a vented check valve 100. One exemplary vented check valve 100 is made of a thermoplastic elastomer (TPE), or a Polyolefin Elastomer, such as Dow Engage® 8401. Vented check valve 100 may be used as an inlet check valve in a liquid pump. Exemplary embodiments of such liquid pumps are described in more detail below. The vented check valve 100 includes a projecting member 102 for securing the valve in position in a pump housing (not shown) and a sealing member 104. Sealing member 104 includes one or more venting recess(es) or notch(es) 106 in the sealing member 104. As described in more detail below, venting recess 106 provides a path for air to escape out of a pump chamber (not shown). Venting recess 106 may be a sharp notch, a rounded notch, a hole, one or more slits or the like.

Venting recess 106 has a recess depth 110. Sealing member 104 has a depth 112. In one embodiment, the sealing member 104 depth 112 is about 0.090 inches and the venting recess 106 depth 110 is about 0.025 inches. In some embodiments, recess depth 110 of venting recess 106 is less than about 20% of depth 112 of sealing member 104. In some embodiments, recess depth 110 of venting recess 106 is less than about 30% of depth 112 of sealing member 104. In some embodiments, recess depth 110 of venting recess 106 is less than about 40% of depth 112 of sealing member 104. In some embodiments, recess depth 110 of venting recess 106 is less than about 50% of depth 112 of sealing member 104.

Figure 2A:
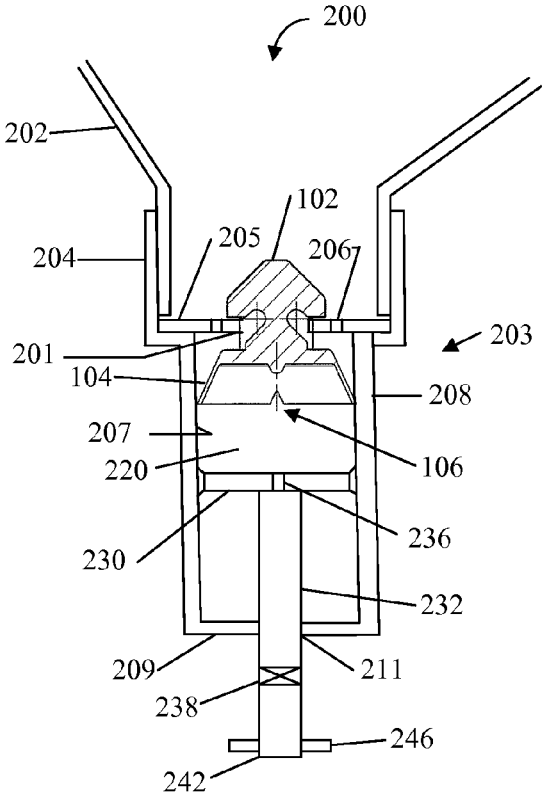
FIG. 2A illustrates the exemplary embodiment of the vented check valve of FIGS. 1A and 1B in a pump connected to a container; wherein the pump is set up to be short-stroked and the piston is at the innermost end of its travel.
Figure 2B:
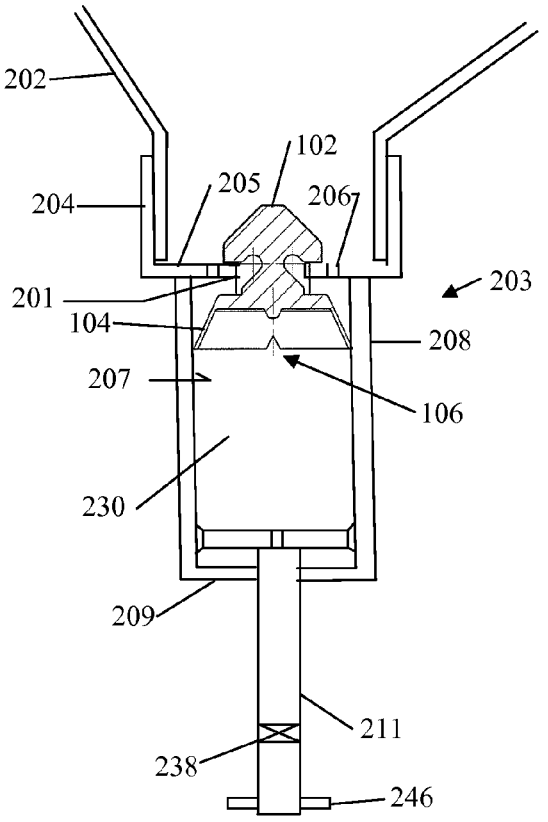
FIG. 2B illustrates the exemplary embodiment of the vented check valve of FIGS. 1A and 1B in a pump connected to a container wherein the piston is at the outermost end of its travel.

FIGS. 2A and 2B illustrate the exemplary vented check valve 100 in a refill unit 200. Refill unit 200 includes a container 202 for holding a liquid. In some embodiments, the liquid is a foamable liquid. In such embodiments, the exemplary refill unit 200 includes a mixing chamber (not shown)

and an air inlet (not shown) into the mixing chamber. In addition, an air compressor (not shown) would be included. The air compressor may be separate from the refill unit 200 or integral with the refill unit 200.

Connected to container 202 is a pump housing 203. Pump housing 203 includes a cap 204 that is securable to container 202. Cap 204 and container 202 may be connected by a threaded connection, a snap-fit connection, a welded connection, an adhesive connection or the like. A base 205 is located within cap 204. Base 205 includes a mounting aperture 201 for receiving and retaining vented check valve 100. During assembly, projection 102 is forced up through aperture 201 and projection 102 retains vented valve 100 in place. In addition, base 205 includes one or more liquid inlet apertures 206.

Pump housing 203 includes cylindrical wall 208 and cylindrical base 209. Located within pump housing 203 is a liquid pump chamber 220. A piston 232 is moveable within liquid pump chamber 220. In one embodiment, piston 232 is hollow and has a piston head 230 located at one end. An aperture 236 in piston head 230 places the interior of piston 232 in fluid communication with the liquid pump chamber 220. An outlet check valve 238 is located in fluid communication with the hollow interior of piston 232, and in one embodiment is located within piston 232. An outlet 242 is located downstream of the outlet check valve 238. In some embodiments, a mixing chamber (not shown) and an air inlet (not shown) are included and located downstream of the outlet check valve 238. In addition, a mix media may be located downstream of the outlet check valve 238. Mix media may be, for example, one or more screens, baffles, sponge, porous material or the like that causes liquid and air to mix together to form a foam. Piston 232 includes annular projection 246 for engaging with an actuator (not shown) of a dispenser (not shown) for operating pump 203.

The vented check valve may be used in many types of conventional pumps used today for the dispensing of liquid soap and sanitizers. Other exemplary embodiments of liquid and foam pumps that may be used with the exemplary embodiments of vented check valves include U.S. patent application Ser. No. 13/208,076, titled Split Body Pumps for Foam Dispensers and Refill Units, filed on Aug. 11, 2011; U.S. Provisional Patent Application No. 61/692,290, titled Horizontal Pumps, Refill Units and Foam Dispensers With Integral Air Compressors, filed on Aug. 23, 2012; and U.S. Provisional Patent Application No. 61/695,140, titled Horizontal Pumps, Refill Units and Foam Dispensers, filed on Aug. 30, 2012, each of which is incorporated herein by reference.

Similarly, the vented check valves may be used in many dispensers where it is desirable to short-stroke the dispenser. The dispensers may be designed to be short-stroked, may be modified to be short-stroked in the factory or may be modified to be short-stroked in the field. Exemplary embodiments of dispensers that may utilize the exemplary embodiments of vented check valves if modified to be short-stroked may include, for example, U.S. Pat. No. 7,086,567, titled Wall-Mounted Dispenser Assembly With Transparent Window, filed on Jul. 25, 2002; and U.S. Patent Publication No. 2010/0059550, titled Pump Having a Flexible Mechanism for Engagement With a Dispenser, filed on Sep. 11, 2009, each of which is incorporated herein by reference.

Some prior art pumps fail to prime when the pump is purposely short-stroked to provide a reduce output because air is compressible. Accordingly, if a normal inlet check valve (not shown) is used as a piston travels to its innermost position (which is short of traveling the entire length of the liquid pump chamber) the air compresses. Often the air pressure fails to build up high enough to reach the cracking pressure of the outlet check valve. If it does build enough pressure to open the outlet check valve, some air may escape out of outlet nozzle; however, once the pressure falls below the cracking pressure of outlet check valve, the outlet check valve closes leaving pressurized air in the pump chamber. In addition, with a normal inlet check valve (not shown), as the piston moves outward, the compressed air expands and a vacuum is created in the pump chamber. A normal inlet check valve (not shown) does not open until a vacuum pressure builds up that is greater than the cracking pressure of the normal inlet check valve (not shown). In many cases, although the vacuum pressure increases while the piston moves outward, the vacuum pressure does not increase beyond the cracking pressure of the normal inlet check valve and the valve does not prime.

The refill unit 200 of FIG. 2A illustrates the piston 232 located at its innermost position when refill unit 200 is installed in a dispenser (not shown) that is set up to short-stroke the pump 203 so that the dispenser has a smaller output dose. In some embodiments, the recess 106 of inlet check valve 100 forms an opening between the inside wall 207 of cylindrical wall 208 and seal 104 of inlet check valve 100. Thus, vented inlet check valve 100 becomes essentially a normally open valve. Accordingly, liquid may flow into the pump chamber 220 through recess 106 and air may flow out of pump chamber 220 and up into container 202.

In some embodiments, recess 106 does not form an "opening" between the inside wall 207 and seal 104; however, it does form a weakened area, or an area that has a lower cracking pressure. In such embodiments, the lower cracking pressure in that area allows air trapped in liquid pump chamber 220 to be forced out of the liquid pump chamber 220 without significantly raising the air pressure in the liquid pump chamber 220. Accordingly, when piston 232 is moved toward its outermost position, shown in FIG. 2B, liquid is drawn into liquid chamber 220.

When piston 232 moves back to the position shown in FIG. 2A and compresses liquid chamber 220, air may flow up into container 202 until the air has been evacuated from the liquid pump chamber 220, sufficient pressure builds to seal of inlet valve 100 against inner wall 207, or liquid contacts the sealing member 104 and causes the sealing member 104 to seal against inner wall 207. As the liquid pump chamber 220 continues to compress, liquid is forced from liquid pump chamber 220 through opening 236 and through the hollow interior of piston 232 past outlet check valve 238 and out of outlet nozzle 242.

Figure 3:
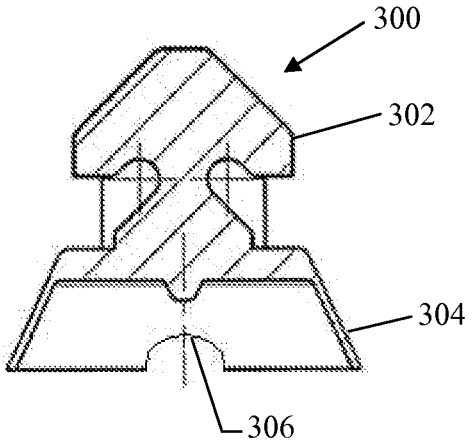
FIG. 3 illustrates another exemplary embodiment of a vented check valve.

FIG. 3 illustrates another exemplary embodiment of a vented inlet check valve 300. Inlet check valve 300 includes a projection 302 for securing inlet check valve 300 to a housing (not shown). Inlet check valve 300 includes a sealing member 304. Sealing member 304 has a venting recess 306. Venting recess 306 has an arcuate shape. Additional shapes for venting recesses are contemplated herein, such as, for example, a sharp notch as shown in FIGS. 1A-2B, a plurality of slits, a u-shape cutout or the like. The venting recess 306 forms a passageway that may be normally open when the inlet check valve is not under pressure from the pump chamber, or forms a weakened cracking pressure in that area for the passage of air that seals to prevent liquid from flowing past.

Figure 4:
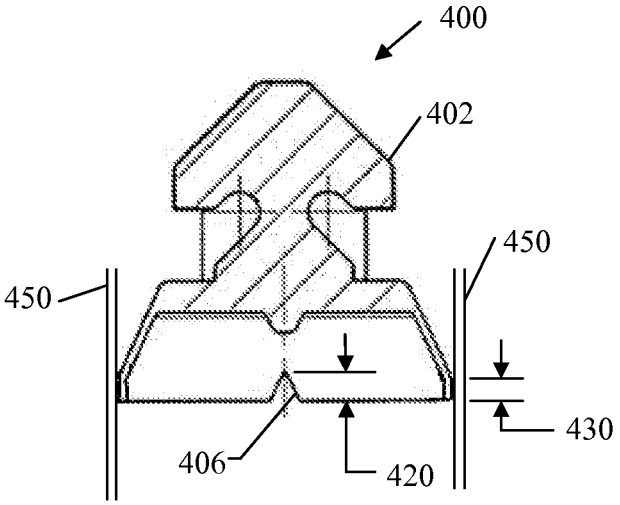
FIG. 4 illustrates yet another exemplary embodiment of a vented check valve.

FIG. 4 illustrates yet another exemplary embodiment of inlet check valve 400. Inlet check valve 400 is illustrated in a pump housing 450. Check valve 400 has an interference fit with housing 450 (which is exaggerated in FIG. 4 and not shown to scale for illustrative purposes). Sealing member 404 has a contact depth 430 with wall 450. Vented recess 406 has a recess depth 420. In one embodiment, sealing member 404 has a contact depth 430 of about 0.011 inches and venting recess 406 depth 420 of about 0.025 inches. In some embodiments, recess depth 420 is greater than about 100% of contact depth 430. In some embodiments, recess depth 420 is greater than about 130% of contact depth 430. In some embodiments, recess depth 420 is greater than about 140% of contact depth 430. In some embodiments, recess depth 420 is greater than about 150% of contact depth 430. In some embodiments, recess depth 420 is greater than about 200% of contact depth 430.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicant's general inventive concept.

I claim:

1. A refill unit for a dispenser comprising:
a container for holding a liquid;
a pump secured to the container;
the pump having a pump chamber;
an inlet check valve located upstream of the pump chamber;
the inlet check valve having an annular seal; and
a venting recess located in the annular seal;
wherein air in the pump chamber may pass through the venting recess in the annular seal and flow into the container;
wherein the venting recess depth is less than about 30% of the contact depth of the annular seal against a wall of the pump chamber.

2. A refill unit for a dispenser comprising:
a container for holding a liquid;
a pump secured to the container:
the pump having a pump chamber;
an inlet check valve located upstream of the pump chamber;
the inlet check valve having an annular seal; and
a venting recess located in the annular seal;
wherein air in the pump chamber may pass through the venting recess in the annular seal and flow into the container;
wherein the venting recess depth is less than about 50% of the contact depth of the annular seal against a wall of the pump chamber.

3. A pump comprising:
a pump chamber;
the pump chamber defined by a one-way liquid inlet check valve, a one-way liquid outlet check valve and at least one wall;
the volume of the pump chamber movable between a first volume and a second volume;
the inlet check valve having an annular seal and a venting recess;
wherein the venting recess allows air to flow past the inlet check valve in the opposite direction of the flow of liquid into the pump chamber;
wherein the venting recess depth is less than about 50% of the contact depth of the annular seal against a wall of the pump chamber.

4. A pump comprising:
a pump chamber;
the pump chamber defined by a one-way liquid inlet check valve, a one-way liquid outlet check valve and at least one wall;
the volume of the pump chamber movable between a first volume and a second volume;
the inlet check valve having an annular seal and a venting recess;
wherein the venting recess allows air to flow past the inlet check valve in the opposite direction of the flow of liquid into the pump chamber;
wherein the venting recess depth is less than about 50% of the contact depth of the annular seal against a wall of the pump chamber.

5. A refill unit comprising:
a container for holding a liquid;
a pump chamber secured to the container;
the pump chamber defined at least in part by a one-way liquid inlet check valve, a one-way liquid outlet check valve and at least one wall;
the volume of the pump chamber movable between a first volume and a second volume;
the inlet check valve having a venting recess;
wherein the venting recess is located in a portion of the inlet check valve that contacts a wall to form a one-way seal;
wherein the venting recess allows air to flow past the inlet check valve in the opposite direction of the flow of liquid into the pump chamber.

6. A refill unit for a dispenser comprising:
a container for holding a liquid;
a pump secured to the container;
the pump having a pump chamber;
an inlet check valve located upstream of the pump chamber;
the inlet check valve having an annular seal; and
a venting recess located in the portion of the annular seal that seals against a wall;
wherein air in the pump chamber may pass through the venting recess in the annular seal and flow into the container.

7. The refill unit of claim 1 wherein the venting recess is a notch.

8. The refill unit of claim 1 wherein the venting recess has an arcuate shape.

9. The refill unit of claim 1 wherein the venting recess depth is greater than about 100% of the contact depth of the annular seal against a wall of the pump chamber.

10. The refill unit of claim 1 further comprising a mixing chamber and an air inlet.

11. The refill unit of claim 10 further comprising an air compressor secured to the refill unit and in fluid communication with the air inlet.

12. The refill unit of claim 1 further comprising a liquid.

13. The refill unit of claim 12 wherein the liquid is a foamable liquid.

14. The refill unit of claim 1 further comprising a piston movable within the pump chamber.

15. A pump comprising:
a pump chamber;
the pump chamber defined by a one-way liquid inlet check valve, a one-way liquid outlet check valve and at least one wall;

the volume of the pump chamber movable between a first volume and a second volume;

the inlet check valve having a venting recess;

wherein the venting recess is located in a portion of the inlet check valve that contacts a wall to form a one-way seal;

wherein the venting recess allows air to flow past the inlet check valve in the opposite direction of the flow of liquid into the pump chamber.

16. The pump of claim 15 wherein the venting recess is a notch.

17. The pump of claim 15 wherein the venting recess has an arcuate shape.

18. The pump of claim 15 further comprising a mixing chamber and an air inlet.

19. The pump of claim 15 further comprising a container secured to the pump and a liquid in the container.

20. The pump of claim 15 further comprising a piston movable within the pump chamber.

* * * * *